US006550749B2

(12) United States Patent
Vick

(10) Patent No.: US 6,550,749 B2
(45) Date of Patent: Apr. 22, 2003

(54) SYSTEM FOR ACTUATING A CARBURETOR OF AN INTERNAL COMBUSTION ENGINE

(75) Inventor: Christian Vick, Winsen (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 09/861,238

(22) Filed: May 18, 2001

(65) Prior Publication Data

US 2002/0005596 A1 Jan. 17, 2002

(30) Foreign Application Priority Data

May 22, 2000 (DE) ..... 200 09 208 U

(51) Int. Cl.[7] ..... F02M 19/12
(52) U.S. Cl. ..... 261/52; 123/179.18; 261/64.6
(58) Field of Search ..... 261/52, 64.6; 123/179.18

(56) References Cited

U.S. PATENT DOCUMENTS

| | | | | | |
|---|---|---|---|---|---|
| 2,140,776 | A | * | 12/1938 | Trisler | 261/52 |
| 2,166,899 | A | * | 7/1939 | Blattner | 261/52 |
| 2,478,613 | A | * | 8/1949 | Weber | 261/52 X |
| 2,694,558 | A | * | 11/1954 | Jorgensen et al. | 261/52 X |
| 2,770,146 | A | * | 11/1956 | Winkler | 261/52 X |
| 2,786,657 | A | * | 3/1957 | Sutton | 261/52 X |
| 2,982,275 | A | * | 5/1961 | Doman et al. | 261/52 X |
| 4,079,708 | A | | 3/1978 | Wieland et al. | 261/52 X |
| 4,123,480 | A | | 10/1978 | Johansson | 261/52 |
| 4,200,595 | A | * | 4/1980 | Dye | 261/52 X |
| 4,631,153 | A | * | 12/1986 | Tamba et al. | 261/52 |
| 4,961,409 | A | * | 10/1990 | Kobayashi et al. | 261/52 X |
| 5,174,255 | A | * | 12/1992 | Collins et al. | 261/64.6 X |
| 5,215,049 | A | * | 6/1993 | Wolf | 261/64.6 X |
| 5,611,312 | A | * | 3/1997 | Swanson et al. | 261/52 X |

FOREIGN PATENT DOCUMENTS

| | | | | |
|---|---|---|---|---|
| DE | 25 09 443 | | 9/1976 | |
| JP | 52-52043 | * | 4/1977 | 261/52 |
| JP | 58-117340 | * | 7/1983 | 261/64.6 |

* cited by examiner

*Primary Examiner*—Richard L. Chiesa
(74) *Attorney, Agent, or Firm*—McCormick, Paulding & Huber LLP

(57) ABSTRACT

For an internal combustion engine carburetor (10) having a throttle valve (14) and a choke (22), the throttle valve (14) and the choke (22) can be brought in dependence on each other to different sets of predetermined operating positions which are appropriate respectively for the operating of the engine at no-load, for a cold start, and for a warm start, with a safe and definite adjustment being achieved in that the switch (19) is placed directly on the carburetor (10) and is connected with the choke (22) and in that the choke (22) and the throttle valve (14) are coupled with each other over mechanical couplings (16, . . . 21) with the switch (19) having a different position for each set of throttle valve and choke operating positions.

7 Claims, 5 Drawing Sheets

SYSTEM FOR ACTUATING A CARBURETOR OF AN INTERNAL COMBUSTION ENGINE

This invention relates to the field of the internal combustion engines. It concerns a system for actuating a carburetor of an internal combustion engine.

Such a system is known for example from the printed document U.S. Pat. No. 4,123,480.

For the operation of motor driven hand-operated tools such as, for example, motor saws, hedge clippers, lawn mowers or the like, it is desirable to reduce the starting procedure of the engine to a few movements. Therefore, a switch position for the cold start of the engine and another switch position for starting the engine which is warm for running should be provided for. But, in order to start an engine warm for running in a first switch position, the throttle valve of the carburetor must be opened to half gas while in a second switch position for the cold start of the engine the throttle valve must be opened to half gas and the choke must be actuated. Both switch positions should return to an operating position with the acceleration of the engine. A further stop position of the switch for stopping the engine can be integrated into the switch. Such systems are known for example from DE-C2-25 09 443. For these known systems, the individual functions of the carburetor are triggered over at least one separate switch which is not associated to the carburetor and which causes the adjustment over a plurality of levers and rods.

Another carburetor system is known from the printed document mentioned in the introduction. Here, the throttle valve and the choke or the choke valve are directly coupled on the carburetor over a coupling mechanism. This coupling mechanism causes the lock of the throttle valve in the half gas position when the choke valve is closed. The choke valve is operated over a lever mechanism from outside the carburetor. However, with this solution, it is disadvantageous that for adjusting the warm start position (FIG. 4) the choke valve must first be closed and then opened again so that the respective operating position of the carburetor cannot be clearly recognized by the position of the switch for the choke adjustment.

In all, the known carburetor actuating systems have the disadvantage that the individual functions cannot be realized or can only be insufficiently realized according to the switch position. The reason of these functional defects is to be found in particular in too high tolerances in the individual levers.

Thus, the aim of the invention is to create an actuating system for a carburetor for which the individual functions "ready for operation", "warm start"and "cold start"are realized in one switch, whereby the individual functions are indicated by the different position of the switch. Here, it should be assured that the individual switch positions also guarantee the corresponding carburetor functions and do not cause functional defects because of too high tolerances.

The heart of the invention consists in performing the adjustment of the carburetor with a switch directly placed on the carburetor and influencing the choke and in effecting the corresponding shifting of the throttle valve through a corresponding mechanical coupling between the choke and the throttle valve on the carburetor. Thus, a clear correspondence between the switch position and the adjustment of the carburetor is achieved. Simultaneously, lever mechanisms which are subject to tolerance are reduced to a minimum. Preferably, the choke has a choke shaft and the switch is placed directly on the choke shaft.

A preferred configuration of the invention is characterized in that the coupling means comprise a snap-in plate which is caught by the switch against the force of a spring when turning the switch from a starting position into one direction, that the coupling means further comprise a notch lever which is connected with the throttle valve and which determines the position of the throttle valve and that the snap-in plate is configured in such a way that the notch lever snaps into the snap-in plate when turning the switch from the starting position into two different positions of the snap-in plate or of the choke and holds the snap-in plate, whereby the one snap-in position of the snap-in plate corresponds to the opened choke and the other one to the closed choke and the throttle valve is in both cases in half gas position. A precise and safe coupling between the choke and the throttle valve is thus achieved in a simple way.

The automatic return movement preferably ensues in that the lock between the snap-in plate and the notch lever is configured in such a way that by adjusting the throttle valve the lock is lifted by opening the throttle and the switch with the snap-in plate returns into its starting position under the action of the spring.

Another preferred configuration of the system according to the invention is characterized in that the switch can be turned into another position in which the ignition of the engine is prevented. In this way, all necessary operating positions can be set on the carburetor with a sole switch in an uniquely recognizable way.

Further features of the invention will be apparent from the following.

The invention will be explained in detail below by means of embodiments with reference to the attached drawings.

Figure 1:
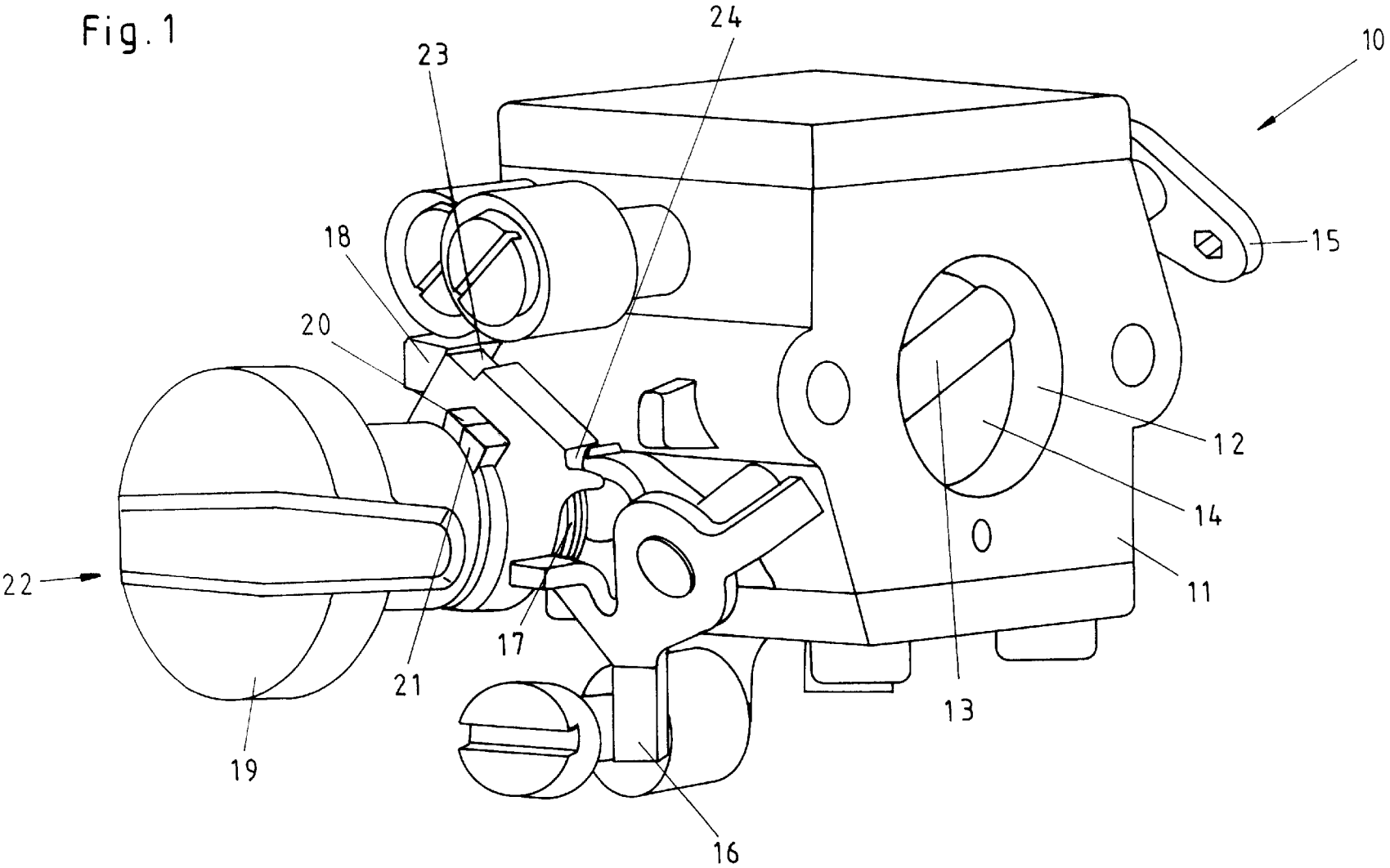
FIG. 1 shows in a perspective representation a preferred embodiment of an actuating system according to the invention in the operating or no-load position.

In FIG. 1, a preferred embodiment of an actuating system according to the invention is represented in the operating or in the no-load position in a perspective representation. The carburetor 10 has a mixture preparing duct 12 in a housing 11, duct in which a throttle valve 14 is placed on a throttle valve shaft 13 and (hidden in FIG. 1) a choke 22 with a corresponding choke valve and a choke shaft. A switch 19 in form of a toggle switch is fixed on the choke shaft of the choke 22, switch with which the choke 22 can be adjusted.

The position of the throttle valve 14 can be changed in two different ways. An actuating lever 15 is placed at the (rear) end of the throttle valve shaft 13, whereby this lever is connected to a (non represented) gas pedal over rods or the like. A notch lever 16 is placed at the other end (at the front end) of the throttle valve shaft 13, notch lever over which the throttle valve 14 can be adjusted by means of the switch 19. The adjustment through the switch is carried out over a snap-in mechanism which couples the choke shaft and the throttle valve shaft 13 with each other. A rotatably positioned snap-in plate 18 is placed on the choke shaft between the switch 19 and the housing 11, whereby this snap-in plate shows on its periphery two snap-in notches 23, 24 placed the one behind the other in the direction of rotation. The snap-in plate 18 is loaded by an anticlockwise acting spring 17 and abuts with a moulded catch 21 against a lever 20 mounted on the switch 19. In the representation of FIG. 1, the carburetor system is in the ready position, i.e. the snap-in plate 18 is in the 0-position, the choke 22 is closed (the choke valve is open) and the throttle valve 14 is in the stand gas position. The operating position is clearly indicated by the switch 19 in horizontal position.

Figure 2:
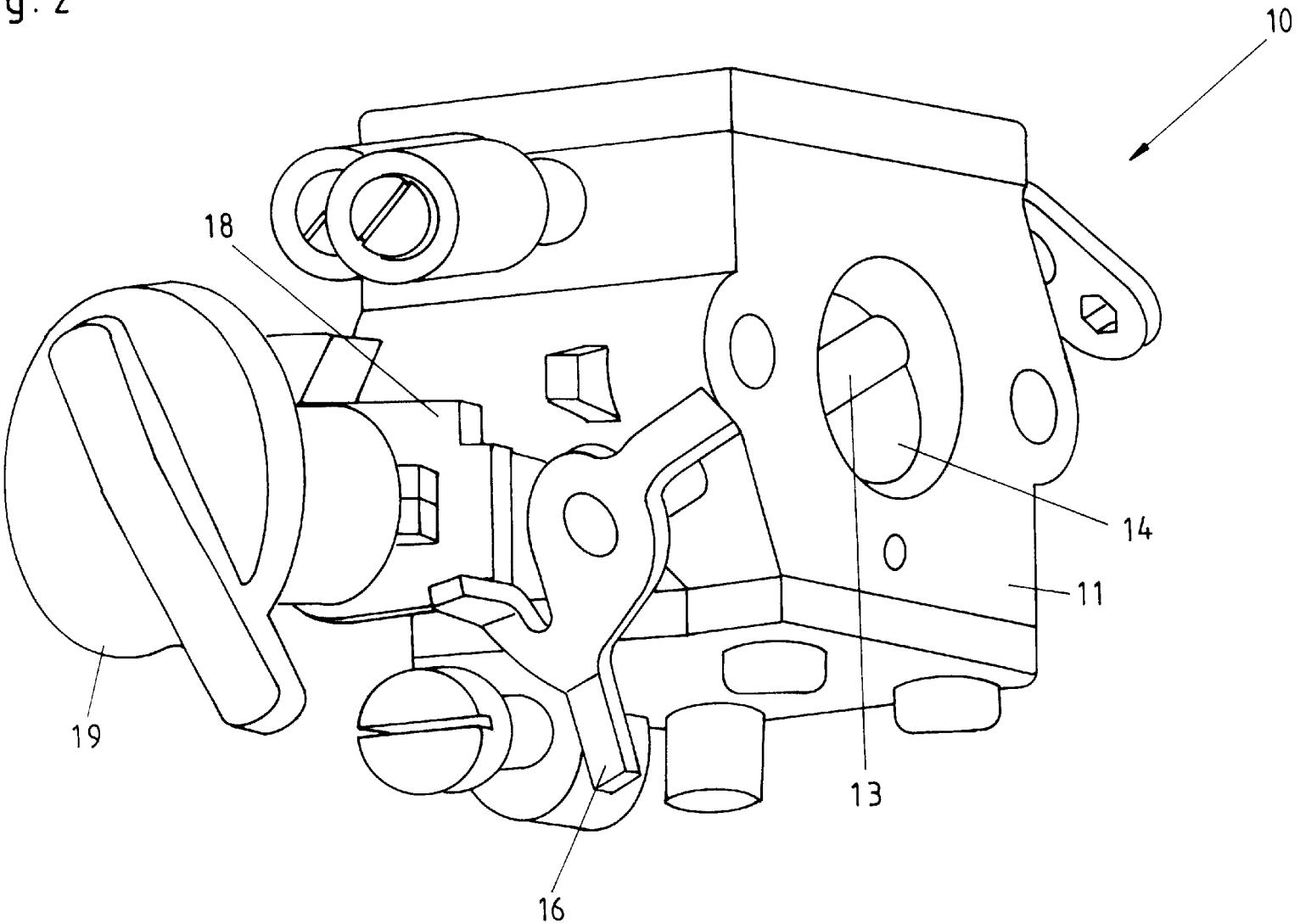
FIG. 2 shows the system of FIG. 1 in the warm start position.

By turning the switch 19 clockwise from the operating position (FIG. 1) into the warm start position represented in FIG. 2, the snap-in plate 18 is caught by the switch 19 against the power of the spring 17 (lever 20, notch 21). The snap-in plate 18 turns the throttle valve 14 into the half gas position over the notch lever 16 mounted on the throttle valve shaft 13. Simultaneously, the notch lever 16 engages into the first snap-in notch 24 on the snap-in plate 18. The snap-in plate 18 and the notch lever 16 wedge against each other so that the throttle valve 14 remains in the half gas position. The snap-in plate 18 then remains unaltered closed in the 1-position of the choke 22.

Figure 3:
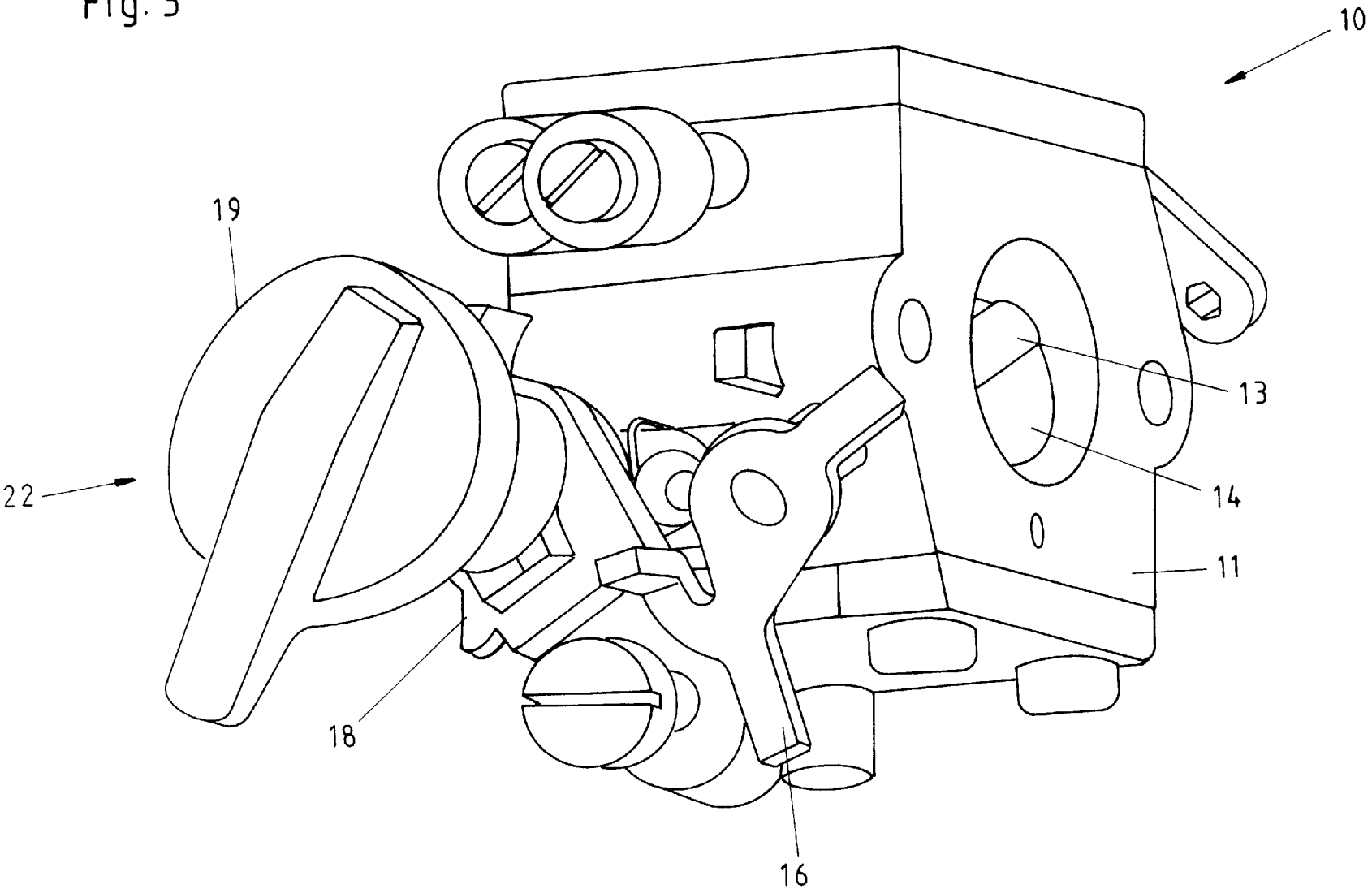
FIG. 3 shows the system of FIG. 1 in the cold start position.

If the switch 19 is turned from the warm start position (FIG. 2) further clockwise into the cold start position represented in FIG. 3, the snap-in plate 18 is caught further until the notch lever engages into the second snap-in notch 23. The snap-in plate 18 and the notch lever 16 of the throttle valve shaft 13 wedge again against each other so that the throttle valve 14 remains in the half gas position. Besides, the choke 22 is switched on now (the choke valve being closed).

Figure 4:
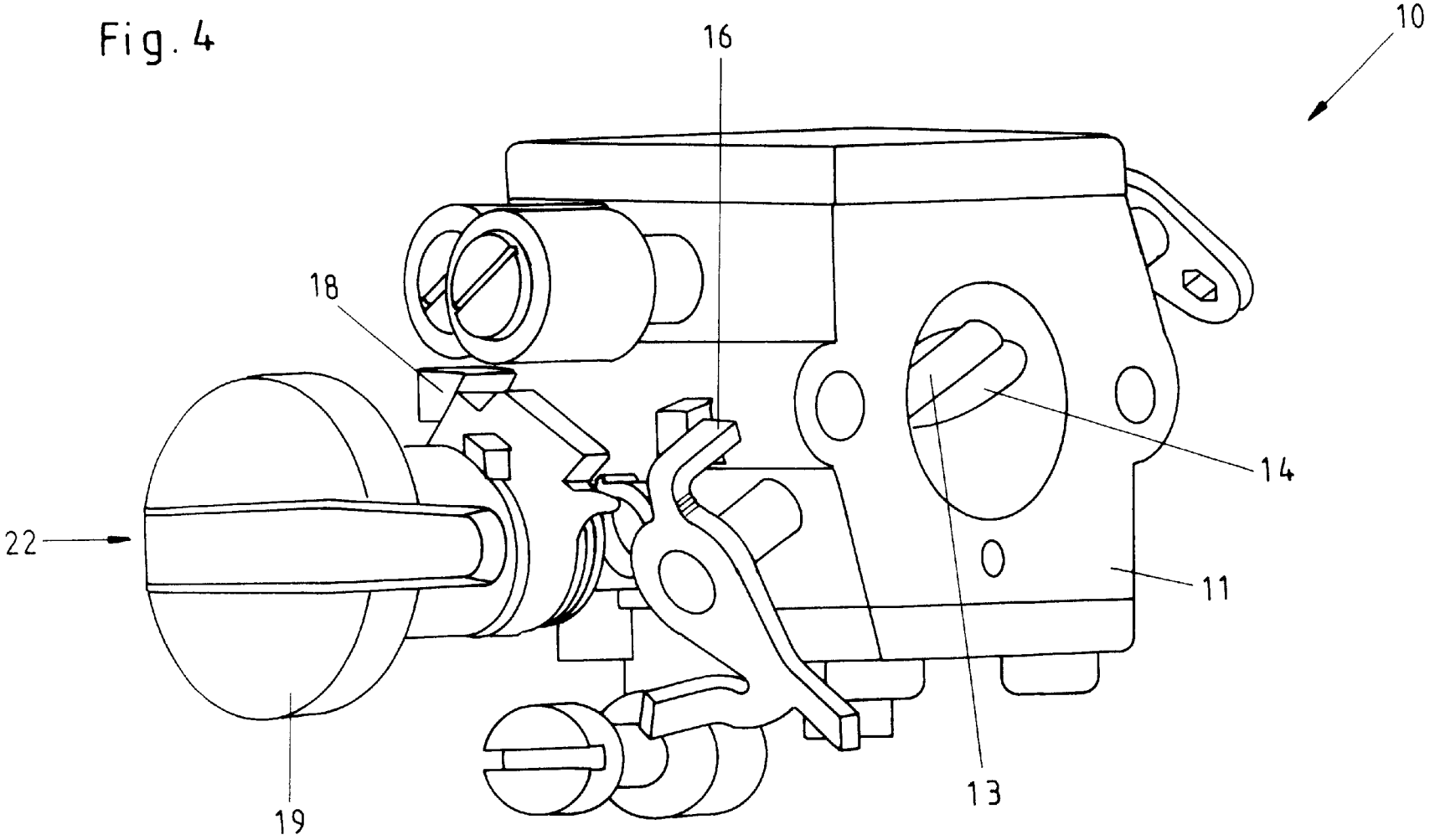
FIG. 4 shows the system of FIG. 1 after the return into the operating position.
Figure 5:
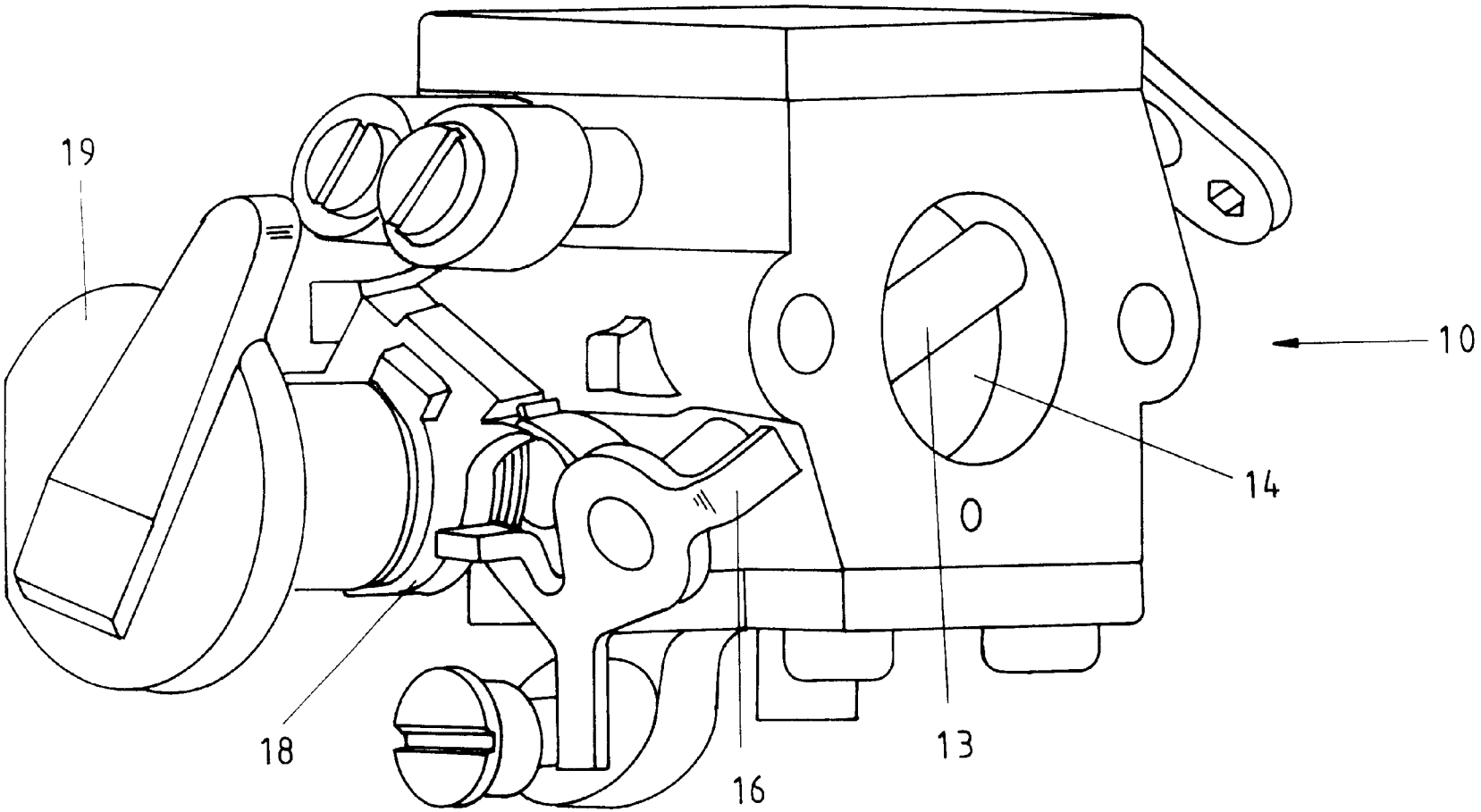
FIG. 5 shows the system of FIG. 1 in the stop position.

In both positions of FIG. 2 and FIG. 3 (warm start position and cold start position), after the actuation of the gas pedal (actuating lever 15) and after the opening of the throttle valve 14 related herewith, the notch lever 16 of the throttle valve shaft 13 is turned out of the snap-in notches 23, 24 of the snap-in plate 18. The snap-in plate 18 is turned back into the operating position after being disengaged by the spring 17 and simultaneously drives the switch 19 (FIG. 4). By further turning the switch 19 anticlockwise from the operating position (FIG. 1) into the stop position (FIG. 5), the engine can be stopped, the ignition circuit being short-circuited by respective contacts placed on the switch 19 or on the choke shaft. The contacts can be configured in such a way that the switch 19 is held in the stop position.

In all, there results from the invention a system for actuating a carburetor with which functional defects due to too high tolerances which would exist by triggering the carburetor over one or several additional levers which are not directly associated to the carburetor, are reliably excluded. Furthermore, the once adjusted operating position can also be manually reversed on the switch into any other operating position.

LIST OF REFERENCE NUMERALS

10 Carburetor
11 Housing
12 Mixture preparing duct
13 Throttle valve shaft
14 Throttle valve
15 Actuating lever
16 Notch lever
17 Spring
18 Snap-in plate
19 Switch
20 Lever
21 Catch
22 Choke (choke shaft)
23,24 Snap-in notch

What is claimed is:

1. A system for actuating a carburetor of an internal combustion engine, said system comprising a carburetor (10) having a throttle (14) and a choke (22), and a switch (19) movable to at least three different positions corresponding respectively to three different sets of predetermined interdependent positions of the throttle valve and choke appropriate respectively for the operating of the engine at no-load, for a cold start, and for a warm start, the switch being placed directly on the carburetor and being connected with the choke (22), and the choke (22) and the throttle valve (14) being coupled with each other by mechanical couplings so that the switch (19) has a different one of said at least three different positions for each of said three different sets of predetermined interdependent positions of the throttle valve and the choke.

2. An actuating system according to claim 1, characterized in that the choke (22) has a choke shaft and that the switch (19) is placed directly on the choke shaft.

3. An actuating system according to claim 2, characterized in that the couplings comprise a snap-in plate (18) which is caught by the switch (19) against the force of a spring (17) when turning the switch (19) from a starting position into one direction, that the couplings further comprise a notch lever (16) which is connected with the throttle valve (14) and which determines the position of the throttle valve (14), and that the snap-in plate (18) is configured in such a way that the notch lever (16) snaps into the snap-in plate (18) when the turning the switch (19) from the starting position into two different positions of the snap-in plate (18) or of the choke (22) and holds the snap-in plate (18), whereby the one snap-in position of the snap-in plate (18) corresponds to the opened choke (22) and the other one to the closed choke (22) and the throttle valve (14) is in both cases in half gas position.

4. An actuating system according to claim 3, characterized in that the lock between the snap-in plate (18) and the notch lever (16) is configured in such a way that by adjusting the throttle valve (14) the lock is lifted by opening the throttle and the switch (19) when the snap-in plate (18) returns to its starting position under the action of the spring (17).

5. An actuating system according to claim 4, characterized in that the choke (22) is closed in the starting position of the switch (19).

6. An actuating system according to claim 5, characterized in that the throttle valve (14) is fixed on the throttle shaft (13) and that the notch lever (16) is placed at one end of the throttle shaft (13).

7. An actuating system according to claim 6, characterized in that the switch (19) can be turned into a further position in which the ignition of the engine is prevented.

* * * * *